US005813219A

United States Patent [19]

Gill et al.

[11] Patent Number: 5,813,219

[45] Date of Patent: Sep. 29, 1998

[54] ROCKET MOTOR PROTECTION DEVICE DURING SLOW COOK-OFF TEST

[75] Inventors: Moshe Gill, Haifa; Itzhak Avnon, Shmuel, both of Israel

[73] Assignee: State of Israel - Ministry of Defence Armament Development Authority, Rafael, Haifa, Israel

[21] Appl. No.: 370,810

[22] Filed: Jan. 10, 1995

[30] Foreign Application Priority Data

Mar. 2, 1994 [IL] Israel ..... 108819

[51] Int. Cl.[6] ..... F02K 9/00

[52] U.S. Cl. ..... 60/223; 60/254; 102/481; 220/88.1

[58] Field of Search ..... 60/223, 234, 253, 60/254; 102/481, 377; 220/88 R–88.1

[56] References Cited

U.S. PATENT DOCUMENTS

| | | | |
|---|---|---|---|
| 4,478,151 | 10/1984 | Vetter et al. | 60/223 |
| 4,911,795 | 3/1990 | Oliff, Jr. | 60/253 |
| 4,961,313 | 10/1990 | Dolan | 60/223 |
| 5,044,154 | 9/1991 | English, Jr. et al. | 60/223 |
| 5,228,285 | 7/1993 | Van Name et al. | 60/253 |

FOREIGN PATENT DOCUMENTS

WO 90/01635 2/1990 WIPO .

*Primary Examiner*—Charles G. Freay
*Attorney, Agent, or Firm*—Cowan, Liebowitz & Latman, P.C.

[57] ABSTRACT

The invention relates to a device for imparting a non-explosive and a non-propulsive property to a rocket motor casing made from a composite material during a slow cook-off test, which consists of using a predetermined pyrotechnic pellet having an ignition temperature of at least 140° C. but below the violent ignition temperature of the propellant material under slow cook conditions, whereby the composite material of said casing is significantly weakened in the predetermined temperature, causing a casing failure and a non-propulsive burning of the rocket motor. The predetermined pyrotechnic pellet is located on the inner surface and will ignite the propellant grain at a lower rate.

8 Claims, 1 Drawing Sheet

ROCKET MOTOR PROTECTION DEVICE DURING SLOW COOK-OFF TEST

The present invention relates to a safety mechanism for rocket motors. More particularly, the invention relates to a protective slow cook-off mechanism for providing automatically protection by ignition of a rocket motor, to be non-explosive and non-propulsive.

BACKGROUND OF THE INVENTION

The slow cook-off test is a well-known test included in the Insensitive Munitions program. The purpose of this program is to develop munitions which fulfill their performance and operational requirements, while minimizing the violence of the reaction and subsequent damage when subjected to any undesired event. As known, one of the primary dangers from storing rockets arises not from the explosion charge, but rather from the rocket motor itself. The slow cook-off test is used to determine the reaction temperature and to measure the overall response of major munition subsystems to a gradually increasing thermal environment. This test consists of subjecting the respective item to be tested, to a gradually increasing temperature at a rate of 6° F. per hour until a reaction occurs. The item to be tested may be preconditioned at the munition's upper environmental temperature limit for about eight hours prior to the start of the test.

Reduced smoke composite propellants, are based on ammonium perchlorate and an elastomeric plastic such as urethane cured polybutadiene, which burn vigorously at low pressure and are difficult to extinguish. Moreover, the composite propellants tend to react very violent in the slow cook-off test itself, even with minimal confinement. The reaction involves an explosion deflagration which destroys the case and breaks up the steel oven walls into several fragments.

A method to prevent the violent reaction of rocket motor containing a metallic housing during the slow cooking-off test is suggested in the U.S. Pat. No. 4,961,313. According to this method, the slow cook-off trigger mechanism is thermally coupled to a bimetallic snap action disc spring.

Another method, as described in the recent U.S. Pat. No. 5,044,154, suggests as a safety mechanism for rendering a rocket motor non-propulsive a casing made from segments which are attached together. A retaining member which extends circumferentially thereabout, possesses a sensitivity to a predetermined initiated temperature. This temperature is higher than the ambient one, but lower than the ignition temperature of the propellant material in the rocket motor. In this manner, it will loose its strength when the retaining member is released and thus the rocket motor may safely be rendered non-propulsive during a slow cook-off test.

In the European Patent Application No. 900816, a slow cook-off protection is suggested for a rocket motor having a metallic housing. The safety apparatus comprises a trigger working by a bimetallic snap-action spring to sense the temperature of the ambient environment and generate a mechanical response when the temperature reaches a predetermined temperature. The trigger ignites a charge which creates a stress riser and deactivates the propulsion thrust capability in response to the mechanical response. It is claimed that the safety apparatus prevents slow cook-off hazard of a rocket.

The main disadvantage of the known devices is based on the fact that the violent reaction of composite propellants rocket motors during the slow cook-off test is almost independent of the casing and therefore, splitting the casing does not provide a good protection against slow cook-off test in such rocket motors. The extreme violence of ammonium perchlorate and an elastomeric binder composite propellant under the slow cook-off test, is mainly due to the partial decomposition of the propellant and particularly to that of the ammonium perchlorate. As known, ammonium perchlorate undergoes a partial decomposition, generating a porous, metastable product. This porous material tends to explode or to undergo a chemical reaction producing a vigorous evolution of heat and flame which moves through the material, upon ignition at high temperature.

It is an object of the present invention to provide a device for imparting protection during a slow cook-off test for a rocket motor casing made from a composite material. It is another object of the present invention, to provide a simple device for imparting a non-explosive reaction and non-propulsive property to a rocket motor containing a reduced smoke composite material during a slow cook-off test. It is yet another object of the present invention, to provide a simple device for imparting a non-explosive reaction and a non-propulsive property to a rocket motor containing a reduced smoke composite material which is reliable and inexpensive.

BRIEF DESCRIPTION OF THE INVENTION

The invention relates to a device for imparting a non-explosive and non-propulsive properties to a rocket motor casing made from a composite material during a slow cook-off test, which consists of using a predetermined pyrotechnic pellet having an ignition temperature of at least 140° C., but below the violent ignition temperature of the propellant material under slow cook-off conditions, whereby the composite material of said casing loses its strength at the predetermined temperature, causing a casing failure and a non-propulsive burning of the rocket motor. The rocket motor ignition system, will be initiated when the ambient temperature of the rocket motor will be above 140° C., but below the self-ignition temperature of the propellant itself. The most preferred materials for the pyrotechnic pellets are selected from double-based propellants, such as: a mixture of nitroglycerine and nitrocellulose and additives, black powder, mixture of magnesium powder with teflon powder, boron barium chromate and any other known solid propellants which comply with the above requirement for the ignition temperature. Optionally, in order to improve the physical and chemical properties of the double-based propellants, small amounts of additives may be incorporated as stabilizers.

DETAILED DESCRIPTION OF THE FIGURES AND INVENTION

Figure 1:
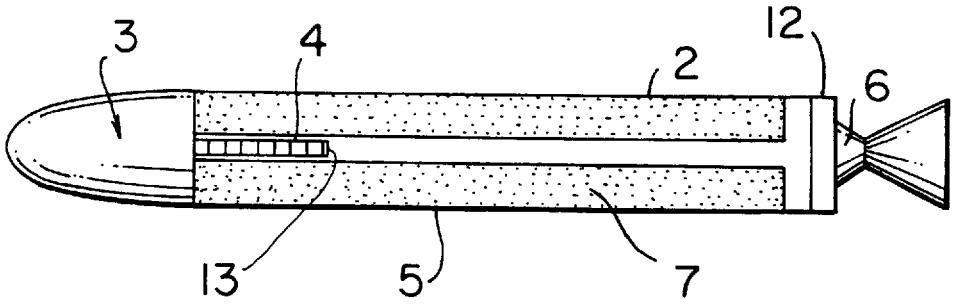
FIG. 1, is a cross-section of a typical missile containing a rocket motor and a safe/arm ignition system.

FIG. 1 illustrates schematically a cross-section of a typical missile. The missile illustrated, includes a rocket motor (2), an explosive warhead (3) and a safe/arm ignition system (4) which is mounted coaxially in the rocket motor (2). The rocket motor (2) includes the casing (5), the nozzle (6) and the propellant (7). A venting device (12) to avoid propulsive burning is provided, connecting the rocket motor casing (5)

to the nozzle (6). The predetermined pyrotechnic pellet (11) is located in the safe ignition system (4).

Figure 2:
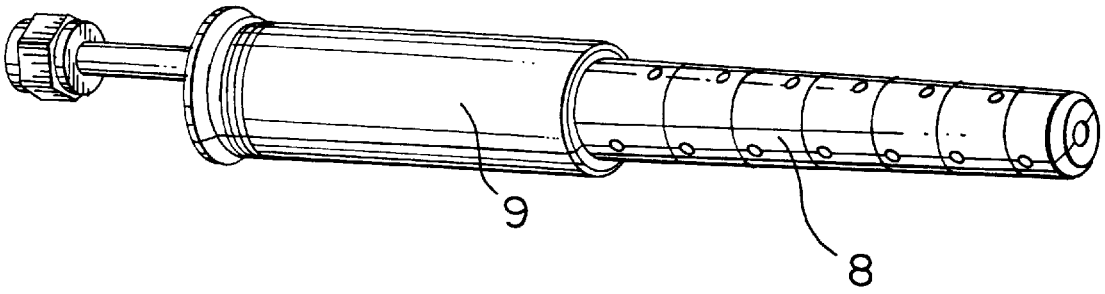
FIG. 2, is a cross-section of a typical safe/arm ignition system used to ignite a rocket motor containing a predetermined ignition temperature pyrotechnical pellet according to the present invention.

In FIG. 2, the safe/arm ignition system (4) includes a perforated plastic tube (8) which is threaded in a safe/arm device (9). In the plastic tube (8) there are located igniter common pellets together with the predetermined ignition temperature pyrotechnical pellet which activates the igniter pellets.

The predetermined ignition temperature pyrotechnical pellet must be in the inner surface of the propellant grain, but its actual location therein is not critical.

The arrangement tested in the slow cook-off oven, includes the rocket motor and the safe/arm ignition system mounted inside as illustrated in FIG. 1. When the temperature in the slow cook-off oven reached the predetermined value, the predetermined pyrotechnical thermal pellet is ignited and activates the rocket motor igniter pellets. The hot gases and particles resulted from the ignition of said pellets, are going out through the holes of the perforated plastic tube (8) and thus will ignite the propellant material (7). The predetermined pyrotechnical ignition temperature thermal pellet located on the inner surfaces, will ignite the propellant grain.

When the casing of the rocket motor is made of a composite material which includes a resin and fibers, the resin is softened at a temperature of about 130° C. Thus, at a predetermined temperature which is above 130° C. the resin will be significantly weakend. As a consequence, the casing will burst without causing any external effect and thus the propellant will burn non-propulsively at atmospheric pressure due to the full diameter opening of the case.

A detailed description and data of a typical safe/arm ignition system is hereafter presented, being understood, that this are given only for a better illustration of the invention, without limiting its scope as covered by the appending Claims. A person skilled in the art, after reading the present specification will be in a position to insert slight modifications thereof without being outside the scope of the invention as stipulated in the attached Claims.

A typical illustration of a safe/arm ignition system is hereafter presented:

The internal length of the plastic tube about 77 mm.

The internal diameter of the tube about 8 mm.

The tube does contain about 60 pellets (4.8×4.8 mm) of B-$BaCrO_4$ and also some pellets of a di-basic pyrotechnic material, with a diameter of about 7 mm and length of about 20 mm.

The tube contains about 28 holes of 2 mm diameter divided in four rows.

Of course, the above data are given only for illustration purposes indicating some data and dimensions, but no limitation whatsoever could be understood therefrom.

We claim:

1. A device for imparting a non-explosive and a non-propulsive property to a rocket motor casing made from a composite material during a slow cook-off test, which consists of a pyrotechnic pellet having an ignition temperature of at least 140° C. but below the violent ignition temperature of the rocket propellant material under slow cook-off conditions, whereby the composite material of said casing loses its strength at said ignition temperature, said loss of strength causing a casing failure and a non-propulsive burning of the rocket propellant material.

2. The device according to claim 1, wherein the pyrotechnic pellet has an ignition temperature in the range of 140° C. and 150° C.

3. The device according to claim 1, wherein said pyrotechnic pellet is located in the inner surface of the propellant grain.

4. The device according to claim 1, wherein said device includes a perforated plastic tube threaded in a safe arm device.

5. The device according to claim 4, wherein the perforated plastic tube contains common igniter pellets together with a temperature pyrotechnic pellet.

6. The device according to claim 1, wherein said pyrotechnic pellet is made from a double-based propellant.

7. The device according to claim 6, wherein said double-based propellant is selected from the group consisting of nitroglycerine, nitrocellulose and additives thereto, black powder, mixtures of magnesium powder and teflon powder, and boron-barium chromate, and mixtures thereof.

8. The device according to claim 4, wherein the hot gases and particles resulting from the ignition of said pellet are emitted through the holes of the perforated plastic causing the ignition of the rocket propellant material.

* * * * *